US008371668B2

(12) United States Patent
Kasai et al.

(10) Patent No.: US 8,371,668 B2
(45) Date of Patent: Feb. 12, 2013

(54) RECODING ELEMENT SUBSTRATE, RECORDING HEAD EQUIPPED WITH THE SAME, RECORDING HEAD CARTRIDGE, AND RECORDING APPARATUS

(75) Inventors: Ryo Kasai, Tokyo (JP); Tatsuo Furukawa, Zama (JP); Nobuyuki Hirayama, Fujisawa (JP); Tomoko Kudo, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 765 days.

(21) Appl. No.: 12/615,102

(22) Filed: Nov. 9, 2009

(65) Prior Publication Data

US 2010/0118074 A1 May 13, 2010

(30) Foreign Application Priority Data

Nov. 13, 2008 (JP) ..... 2008-291108

(51) Int. Cl.
*B41J 29/38* (2006.01)

(52) U.S. Cl. ..... 347/5; 347/10; 347/11; 347/12; 347/13; 347/14; 347/50; 347/57; 347/58; 347/59

(58) Field of Classification Search ..... 347/5, 10–14, 347/50, 57–59
See application file for complete search history.

(56) References Cited

U.S. PATENT DOCUMENTS 6,290,334 B1 * 9/2001 Ishinaga et al. ..... 347/59
6,672,711 B2 * 1/2004 Kao et al. ..... 347/60
7,126,622 B2 * 10/2006 Omae et al. ..... 347/237
7,252,355 B2 * 8/2007 Umeda ..... 347/10
7,321,444 B2 * 1/2008 Hirayama ..... 358/1.4
2002/0036781 A1 * 3/2002 Hirayama ..... 358/1.4
2007/0296745 A1 12/2007 Kasai

FOREIGN PATENT DOCUMENTS

JP 2008030444 A 2/2008

* cited by examiner

*Primary Examiner* — Ryan Lepisto
*Assistant Examiner* — Guy Anderson
(74) *Attorney, Agent, or Firm* — Canon USA, Inc., I.P. Division

(57) ABSTRACT

A recording element substrate which is provided with a first recording element group and a second recording element group, each group including a plurality of recording elements. The recording element substrate includes a first terminal configured to input a data signal, a second terminal configured to input a latch signal, a shift register configured to receive the data signal input from the first terminal, a first latch circuit configured to latch data stored in the shift register based on the latch signal of a first pulse width input from the second terminal, a second latch circuit configured to latch the data stored in the shift register based on the latch signal of a second pulse width which is shorter than the first pulse width of the latch signal input from the second terminal, a first driving circuit configured to control driving of the recording elements included in the first recording element group based on a signal output from the first latch circuit, and a second driving circuit configured to control driving of the recording elements included in the second recording element group based on a signal output from the second latch circuit.

9 Claims, 14 Drawing Sheets

INK SUPPLY PORT
VH
GNDH
HE
n to N/2 DECODER
LT1(LARGE)
LT2(SMALL)
CLK
DATA
LT3(LARGE)
LT4(SMALL)
LATCH
SHIFT REGISTER
N/2 LINES
BLE
LATCH(LARGE)
LATCH(SMALL)
SMALL
LARGE
HEATER
DRIVER TRANSISTOR
LOGIC CIRCUIT
BLE WIRING LINE

RECODING ELEMENT SUBSTRATE, RECORDING HEAD EQUIPPED WITH THE SAME, RECORDING HEAD CARTRIDGE, AND RECORDING APPARATUS

BACKGROUND OF THE INVENTION

1. Field of the Invention

The present invention relates to a recording element substrate, a recording head equipped with the same, and a recording apparatus.

2. Description of the Related Art

The recording element substrate includes a shift register and a latch circuit in order to drive a recording element. An area of a circuit provided in the recording element substrate has been enlarging due to an increase in a number of recording elements and complexity of control. A semiconductor wafer is used to manufacture the recording element substrate. In order to reduce costs of the recoding element substrate, an area of the recording element substrate needs to be reduced.

For example, Japanese Patent Application Laid-Open No. 2008-030444 discusses a recording element substrate. As illustrated in FIG. 10, the recording element substrate includes a plurality of latch circuits, driving circuits, and decoders sequentially arranged on both sides of a shift register. This circuit latches data input to the shift register with the plurality of latch circuits based on individually prepared latch signals.

FIG. 9 illustrates timing of latch signals. As illustrated in FIG. 9, latch signals LT1, LT2, LT3, and LT4 corresponding to the respective latch circuits are sequentially input. The latch circuits corresponding to the latch signals latch the data of the shift register. Thus, as illustrated in FIG. 10, the recording element substrate includes terminals to which the latch signals LT1, LT2, LT3, and LT4 are input.

By sharing the shift register, a circuit size of the recording element substrate can be reduced. However, a number of terminals to which signals are input cannot be reduced.

SUMMARY OF THE INVENTION

The present invention is directed to a recording element substrate which can improve electrical reliability of a portion connected with a printer by reducing a number of signal input terminals.

According to an aspect of the present invention, a recording element substrate which is provided with a first recording element group and a second recording element group, each group including a plurality of recording elements, includes a first terminal configured to input a data signal, a second terminal configured to input a latch signal, a shift register configured to receive the data signal input from the first terminal, a first latch circuit configured to latch data stored in the shift register based on the latch signal of a first pulse width input from the second terminal, a second latch circuit configured to latch the data stored in the shift register based on the latch signal of a second pulse width which is shorter than the first pulse width of the latch signal input from the second terminal, a first driving circuit configured to control driving of the recording elements included in the first recording element group based on a signal output from the first latch circuit, and a second driving circuit configured to control driving of the recording elements included in the second recording element group based on a signal output from the second latch circuit.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 1:
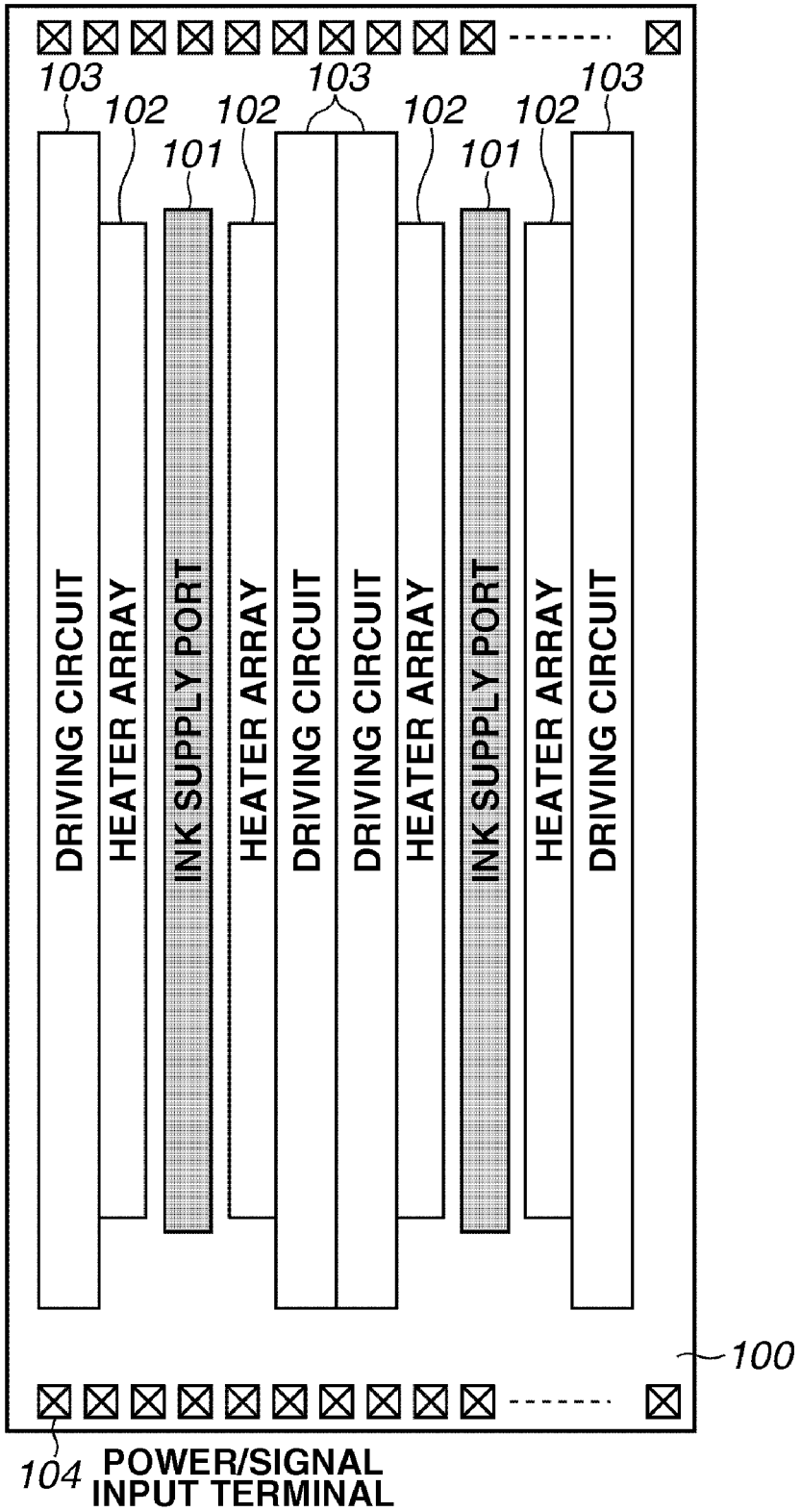
FIG. 1 illustrates a recording element substrate according to an exemplary embodiment of the present invention.

FIG. 1 illustrates an arrangement of circuits in a recording element substrate 100. An exemplary embodiment will be described by taking an example of a recording element substrate for discharging ink.

The recording element substrate 100 includes recording element arrays (heater arrays) 102 which are disposed across an ink supply port 101. Driving circuits 103 for driving the recording elements are disposed next to the recording element arrays 102. A terminal 104 receives a signal or data from a recording apparatus described below. The recording element array (heater array) 102 includes a plurality of recording elements. These recording elements are heaters which are heating resistance elements. The recording element substrate 100 includes two ink supply ports 101.

Figure 2:
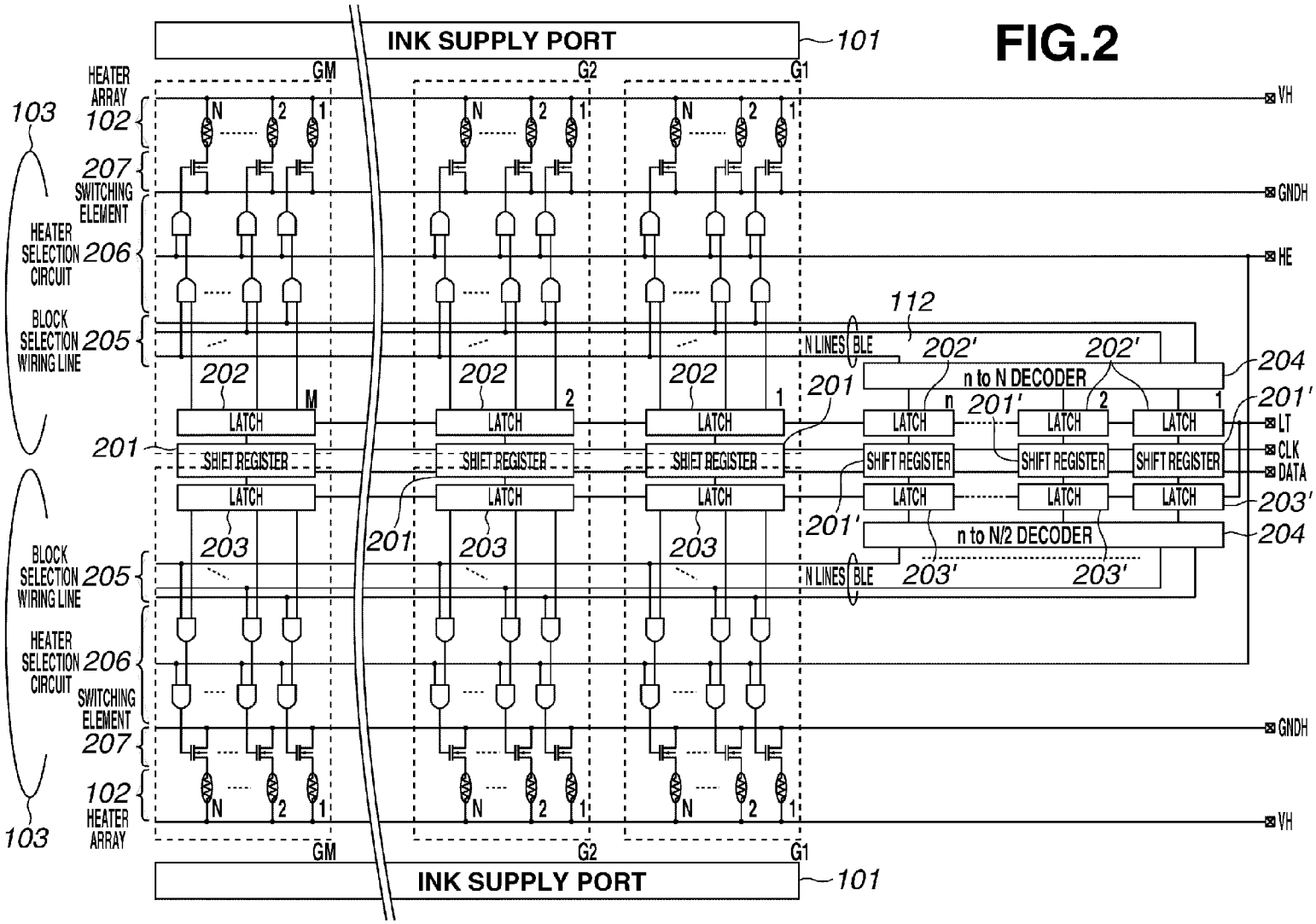
FIG. 2 illustrates a circuit according to a first exemplary embodiment of the present invention.

FIG. 2 illustrates, to simplify the description, an area sandwiched by the two ink supply ports 101 among the circuits disposed in the recording element substrate 100. This area includes the heater arrays 102 and the diving circuits 103 corresponding to the heater arrays 102.

The driving circuits 103 include shift register 201, latch circuits 202 and 203, decoders 204, block selection signal wiring lines 205, heater selection circuits 206, and switching elements 207. The latch circuits 202 and 203 send signals to the heater selection circuits 206 of the respective groups. The heater selection circuit 206 receives a heat enable signal (HE). The heat enable signal (HE) is for permitting heater driving. A period when the HE signal is in a low state is a period in which heater driving is permitted.

In a first exemplary embodiment, two latch circuits which share one shift register will be described as the latch circuit 202 and the latch circuit 203 to be distinguished from each other.

The shift register 201 of the present exemplary embodiment is a 1-bit shift register that serially stores data in synchronization with a clock signal CLK supplied from a printer. The latch circuits 202 and 203 latch 1-bit data stored in the shift register according to a latch signal LT.

Operation speeds based on the latch signal LT are different in the latch circuits 202 and 203. More specifically, time required from when the latch signal LT becomes active (low level) to when the data of the shift register 201 is latched and permitted to be output (periods of latch loading time) is different between the latch circuits 202 and 203.

One recording element array 102 includes M pieces of groups (G1, G2, . . . , GM) each row of which is constituted of N pieces of the recording elements. The recording elements included in each group are selected to be driven in a time-division driving. For example, in each group, a recording element 1 is driven, a recording element 2 is driven at next timing, and a recording element N is lastly driven. After the recording elements 1 to N have been driven, it means completion of driving of the recording elements of one array. The switching element 207 and the heater selection circuit 206 are connected with each other by a control signal line to perform the above driving.

The shift register 201 corresponding to each heater is connected to the latch circuits 202 and 203 to be shared. One shift register 201 is provided for each group. Thus, the recording element substrate 100 includes M pieces of the shift registers as it includes the M groups.

The decoder 204 outputs a block selection signal for selecting one of N heaters disposed in one group. The recording element substrate 100 includes n pieces of the shift registers 201' which store data to be transferred to the decoder 204. Thus, the recording element substrate 100 includes M+n pieces of shift registers.

In this case, the n pieces of 1-bit shift registers 201' may be collected in one place, and n pairs of latch circuits 202' and 203' which are disposed corresponding to the shift registers 201' may be collected in one place.

A data signal (DATA) is first input to a first shift register closest to the input terminal. Then, the data signal (DATA) is input to a second shift register serially connected to the first shift register, and input to a pair of latch circuits 202' and 203' connected to the first shift register. The data signal that has been input to the second shift register is further input to a serially connected third shift register, and input to a pair of latch circuits 202' and 203' connected to the second shift register. Similarly thereafter, the data signal is sequentially input to the shift registers 201 and the latch circuits.

Among the M+n pieces of the shift registers, the M shift registers store 1-bit data corresponding to the groups (1 to M), and transfer the data to the latch circuits 202 and 203 connected to each shift register.

Thus, the area illustrated in FIG. 2 includes M×2 rows of latch circuits (202 and 203) for latching the data of the shift registers 201 and n×2 rows of latch circuits (202' and 203').

Figure 3:
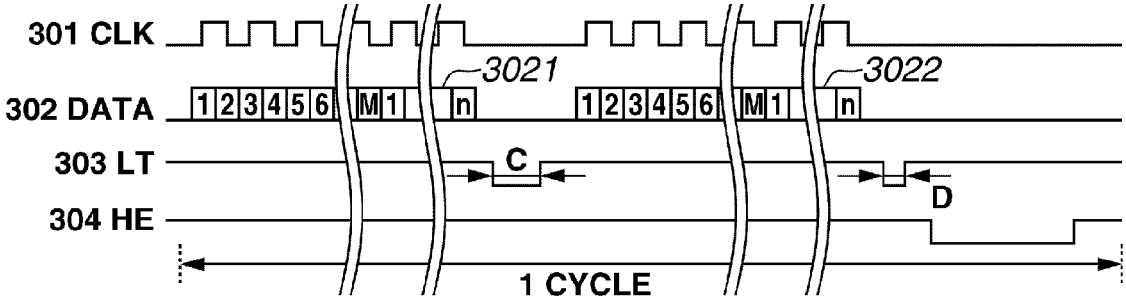
FIG. 3 is a timing chart of signal inputting according to the first exemplary embodiment of the present invention.

FIG. 3 is a timing chart illustrating operations of the circuits illustrated in FIGS. 1 and 2. More specifically, FIG. 3 illustrates input processing performed twice to the shift register 201, latch processing by the latch circuit 202, latch processing by the latch circuit 203, and driving processing in a time sequential manner. 2×M heaters are accordingly driven, so that ink can be discharged. The sequence of FIG. 3 is repeated. A recording operation for one column is performed by executing the sequence of FIG. 3 N times.

Recorded data DATA 302 is input from an input pad of the recording element substrate 100 to drive two arrays of heaters on the left and the right in one discharge cycle. First input data of M+n bits is a data group for driving the left array of heaters, and subsequently input data of M+n bits is a data group for driving the right array of heaters. In each data group, the first M-bit data is for selecting a group of time-division driving, and the subsequent n-bit data is for selecting heaters in the group.

Next, data latching will be described. Data 3021 is input to the shift register 201 in synchronization with a clock signal CLK 301. The latch circuit 202 loads the data at timing when a latch signal LT 303 becomes a low state, and stores the loaded data when the latch signal LT 303 becomes a high state. The low state of the latch signal LT 303 lasts for a period C.

Then, data 3022 is input to the shift register 201. The latch circuit 203 loads the data at timing when the latch signal LT 303 becomes a low state, and stores the loaded data when the latch signal LT 303 becomes a high state. The low state of the latch signal LT 303 lasts for a period D. In this case, there is a relationship of C>D.

Thus, the latch signal LT 303 becomes the low state twice in one cycle, and the second low state period is shorter than the first low state period. The low state period of the latch signal LT corresponds to a data latch loading time (time required until the latched data can be output) of the latch circuit. Hence, latch circuits are configured so that latch loading time of the latch circuit 202 and latch loading time of the circuit 203 can be different from each other.

Data latched by the latch circuits 202' and 203' are transferred to the decoder 204. The decoder 204 outputs a block selection signal. When a heat enable signal (HE) 304 becomes a low state, the switching element 207 selected by the heater selection circuit 206 is turned ON to supply a current to a heater. A sequence of such processing may be performed N times by changing a block selection destination. Accordingly, all (M×n) the heaters can be driven in N times of M heaters each by the time-division driving.

In the present exemplary embodiment, the circuit disposed between the two ink supply ports 101 in FIG. 1 employs the circuit configuration in which the two latch circuits share one shift register. The ink supply port disposed on the recording element substrate and the shift register provided in the driving circuit which is disposed between both ends of the recording element substrate are connected only to one latch circuit.

A data transfer order is not limited to the above example. The order may be reversed as long as processing complies with operation specifications of the latch circuit.

Figure 4A:
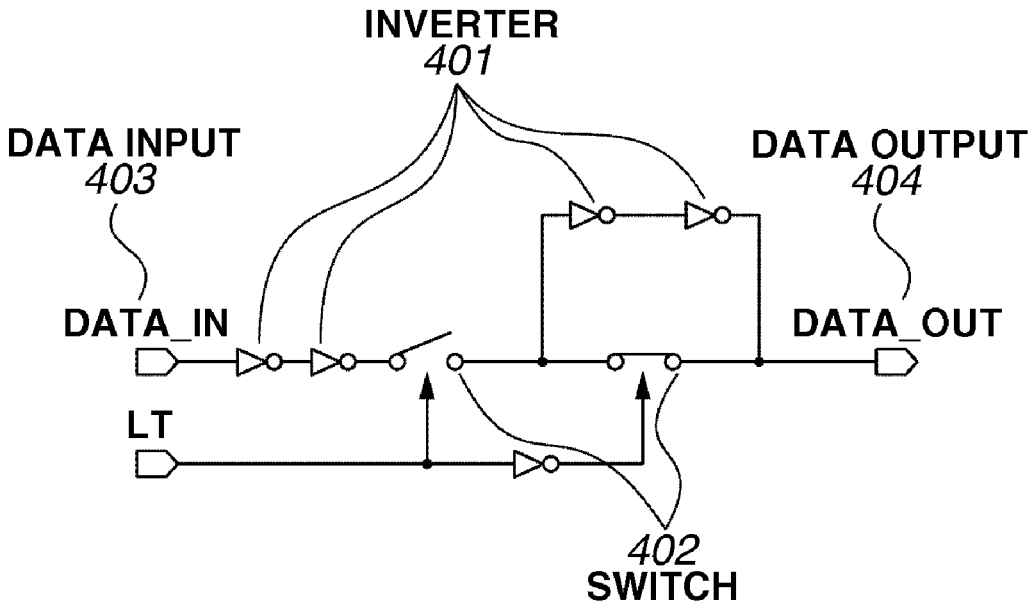
FIG. 4A illustrates a data entry to a latch circuit according to the exemplary embodiment of the present invention.
Figure 4B:
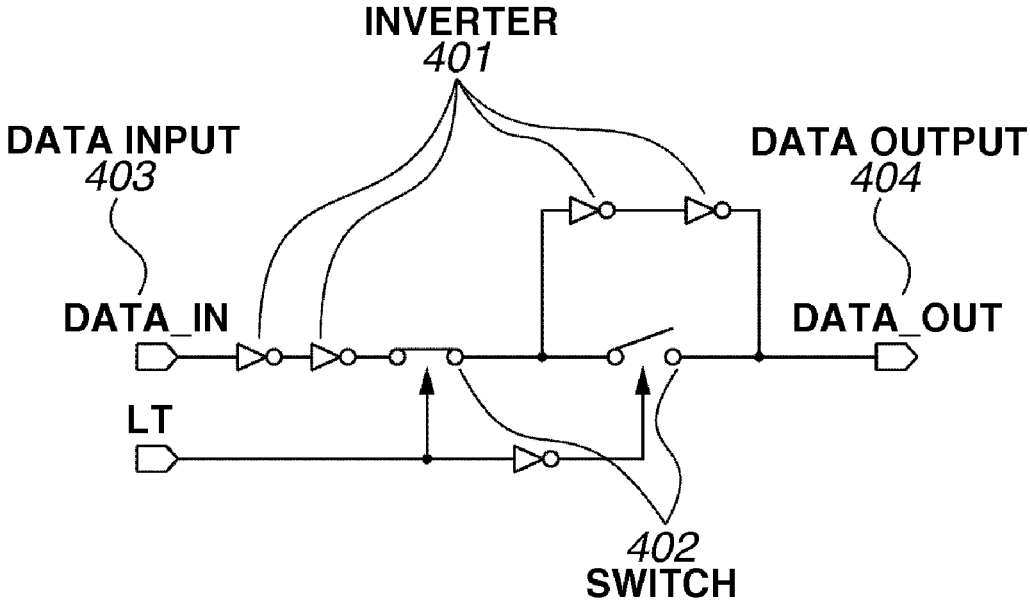
FIG. 4B illustrates an example of latch circuit configuration when it is in a data stored state.

FIGS. 4A and 4B illustrate examples of latch circuit configurations. FIG. 4A illustrates a data stored state (logic of a latch signal is in a high level), and FIG. 4B illustrates a state in which data is being loaded (logic of the latch signal is in a low level, namely an active state). For example, FIG. 4B illustrates a state of a period C or a period D (FIG. 3). The latch circuit includes inverters 401 and switches 402. The switch 402 is changed according to the high or low level of the latch signal LT 303. States of the two switches 402 are always reverse in logic. While one of the switches is ON, the other is OFF.

The present exemplary embodiment employs the configuration that includes the latch circuits different from each other in latch loading time. The latch loading time is determined based on a time required until, in the loaded state of FIG. 4B, a logical state of a data input 403 is reflected in a data output 404 via the inverter 401.

In other words, the latch loading time is determined based on a time required for a voltage of the data output 404 to reach a threshold voltage of the inverter 401. When the logical shifts to the stored state of FIG. 4B without reaching the threshold voltage, the data output 404 is fed back within the latch circuit, the input data is not loaded after all. Thus, the latch loading time is determined based on a driving ability and an output load of the inverter that constitutes the latch circuit.

As a method for adjusting data loading time of the latch circuit, there are a method for adjusting ON resistance by changing a gate width or a length of a metal oxide semiconductor (MOS) constituting the inverter 401, and a method for adjusting an output load (resistance or capacity) of the inverter 401 constituting the latch circuit. A signal output from the latch circuit can be adjusted by combining characteristics of each element constituting the latch circuit.

As described above, there is a relationship of A>B in time length between latch loading time A of the latch circuit 202 and latch loading time B of the latch circuit 203. Further, there is a relationship of C>D between a pulse width (time) C of a first pulse and a pulse width D of a second pulse. Then, there are relationships of C>A>D and D>B between the latch loading time and the pulse widths of the latch signals. An output load, size of a MOS, and ON resistance of the inverter of FIGS. 4A and 4B are set so as to satisfy such relationships.

To summarize, there is a relationship of one latch loading time>the other latch loading time between the two latch circuits which share one shift register. Further, there is a relationship of a pulse width (time) of a first latch signal LT commonly input to the two latch circuits>a pulse width (time) of a second latch signal.

Furthermore, there is a relationship of the pulse width (time) of the first latch signal LT>the latch loading time of the latch circuit>the pulse width (time) of the second latch signal. The latch loading time of the other latch circuit is shorter than the pulse widths of both of the latch signals.

Figure 5A:
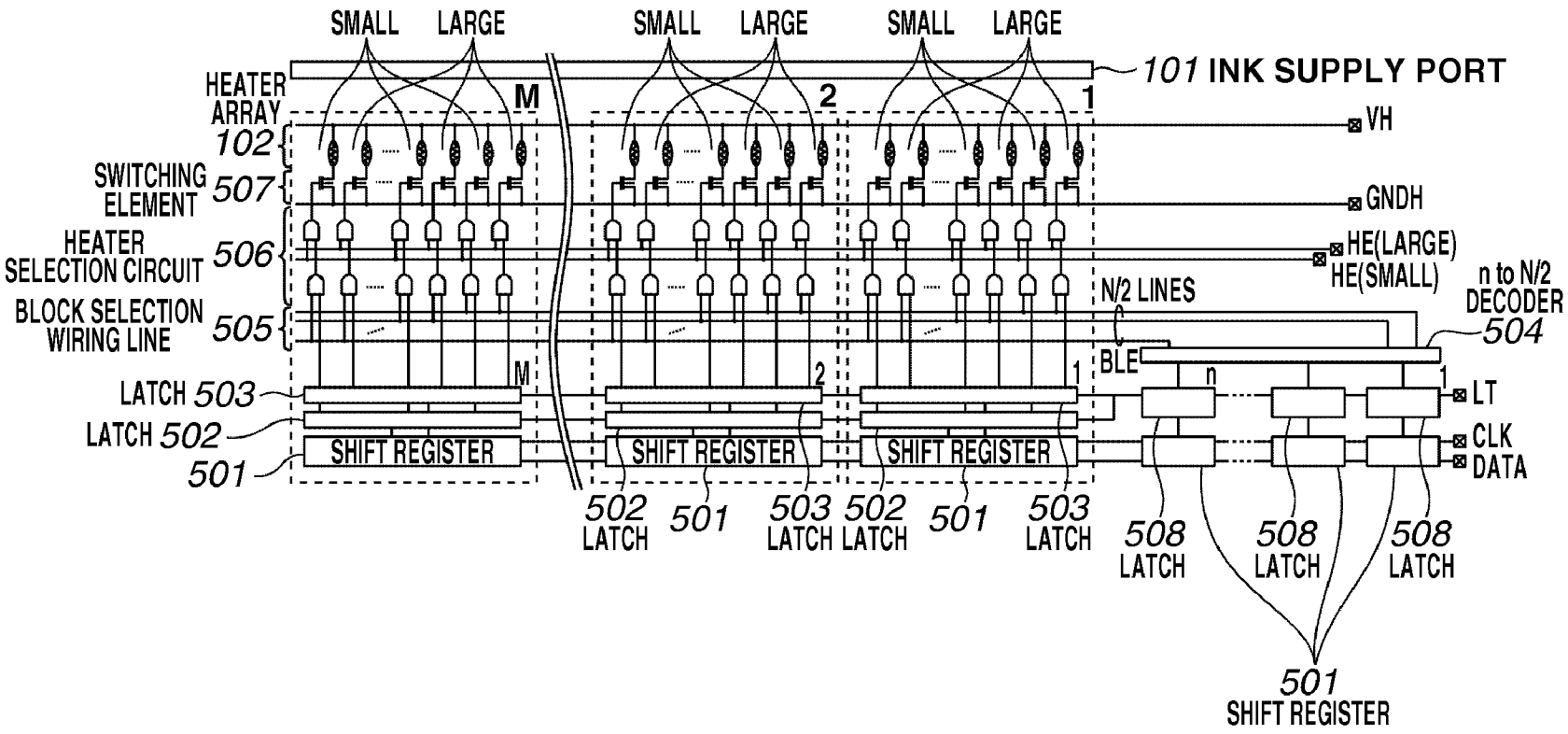
FIG. 5A illustrates a driving circuit of a heater according to a second exemplary embodiment of the present invention.

FIG. 5A illustrates a driving circuit for driving one row of heater arrays according to a second exemplary embodiment. In the second exemplary embodiment, small and large heaters alternately arranged to constitute a heater array 102. The large heater is for discharging large droplets of ink, while the small heater is for discharging small droplets of ink.

An output of one shift register 501 (1 to M) is connected to two latch circuits 502 and 503. These latch circuits 502 and 503 are connected to a heater selection circuit 506. Similar to the first exemplary embodiment, in order to transmit data input to the shift register 501 to a decoder 504, n pieces of latch circuits 508 are provided.

N/2 pieces of the large heaters and N/2 pieces of the small heaters are included in one group. The decoder 504 is required only to deal with the large and small heaters, and hence outputs thereof are N/2.

Figure 6:
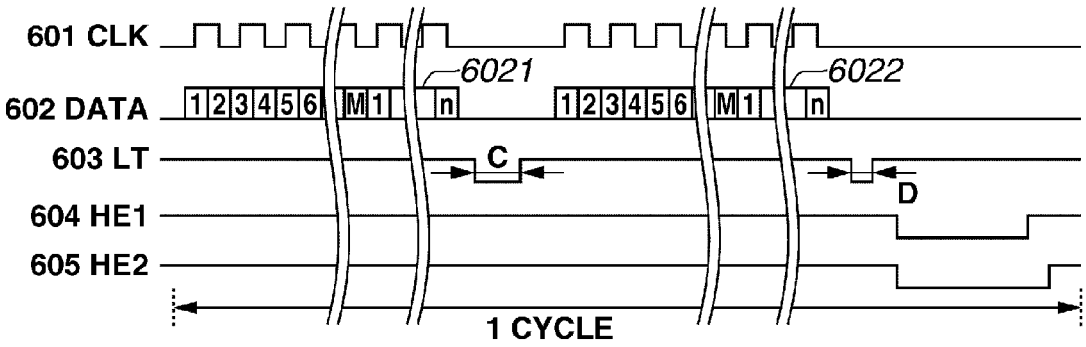
FIG. 6 is a timing chart of signal inputting according to the second exemplary embodiment of the present invention.

FIG. 6 is a timing chart illustrating operations of the circuits. Description of contents similar to those in the first exemplary embodiment illustrated in FIG. 3 will be omitted. Only differences will be described. A number of bits and input times of the data signal to be input, and a number of input times of the latch signal are similar to those of the first exemplary embodiment. A difference is that heat enable signals HE1 and HE2 are simultaneously input.

DATA 6021 which is input first to the shift register is for the small heaters, and DATA 6022 which is input next is for the large heaters. A number that a latch signal LT 603 becomes low and a relationship between a pulse width and latch loading time when the latch signal LT 603 becomes low are similar to those of the first exemplary embodiment. In this case, the latch signals LT 603 have pulse widths C and D (C>D).

As described above, data for large droplets and data for small droplets are stored by corresponding latch circuits, and output to the respective heater selection circuits 506. Thus, desired large and small heaters can be driven.

A data transfer order of the heaters for small droplets and the heaters for large droplets may be reversed as long as there is no contradiction in heater arrangement or corresponding relationship between the latch circuits.

Figure 5B:
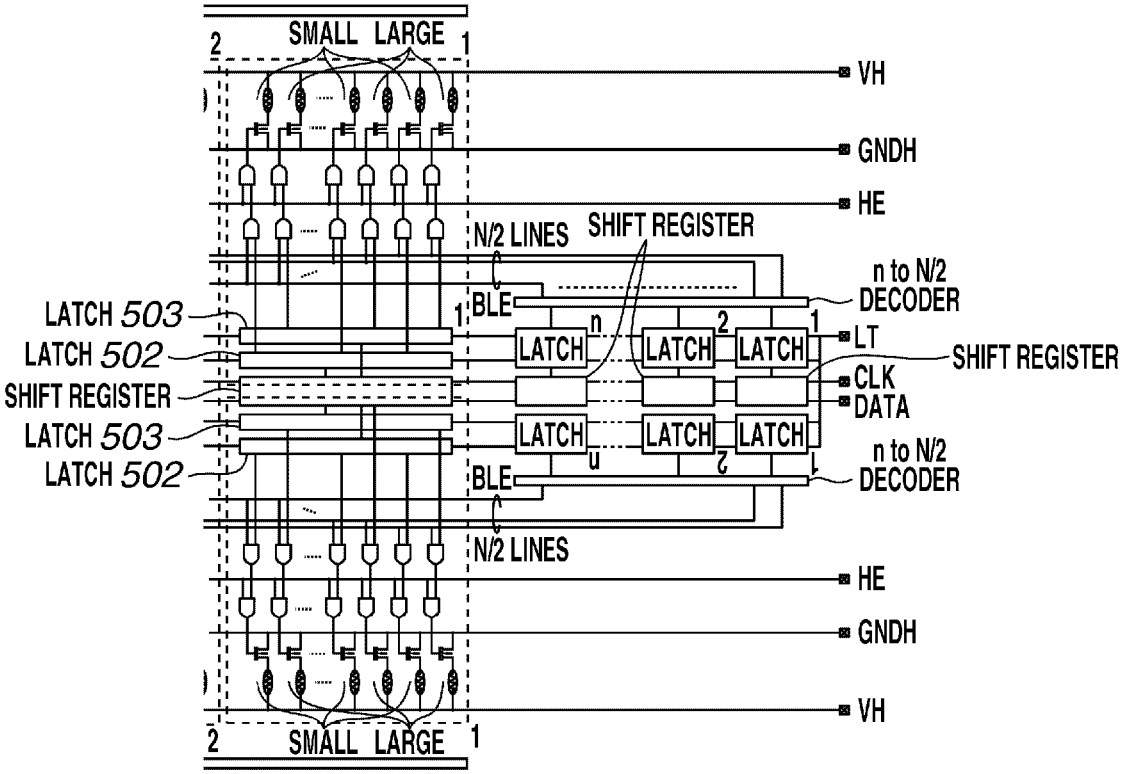
FIG. 5B illustrates a modified example of the driving circuit of the heater according to the second exemplary embodiment of the present invention.

Circuit configuration may be employed, in which the configurations of the first and second exemplary embodiments are combined together and the shift register between the left and right ink supply ports is shared by the large and small heater driving circuits on the left and the right as illustrated in FIG. 5B.

In this case, common latch signals having four types of pulse widths are input from one LT signal input terminal, and data loading time of four large and small latch circuits commonly connected to one shift register are different from one another. In other words, latch circuits different from one another in latch loading time are used between the left and the right and between the large and small heaters in each row. Thus, when the four types of latch circuits different from one another in latch loading time are driven by the common latch signals, signal transfer control is performed so as to provide four latch loading timings within one discharge cycle. Then, control is executed to shorten pulse periods of the latch signals in input order.

The case of the four types of latch circuits has been described. However, the same applies to a case of three types, or five or more types of the latch circuits. In such a case, types (four types, four pulses) of pulse widths of latch signals input from one LT signal input terminal in one discharge cycle and types of data loading time of the large and small latch circuits commonly connected to one shift register are equal in number.

Figure 7:
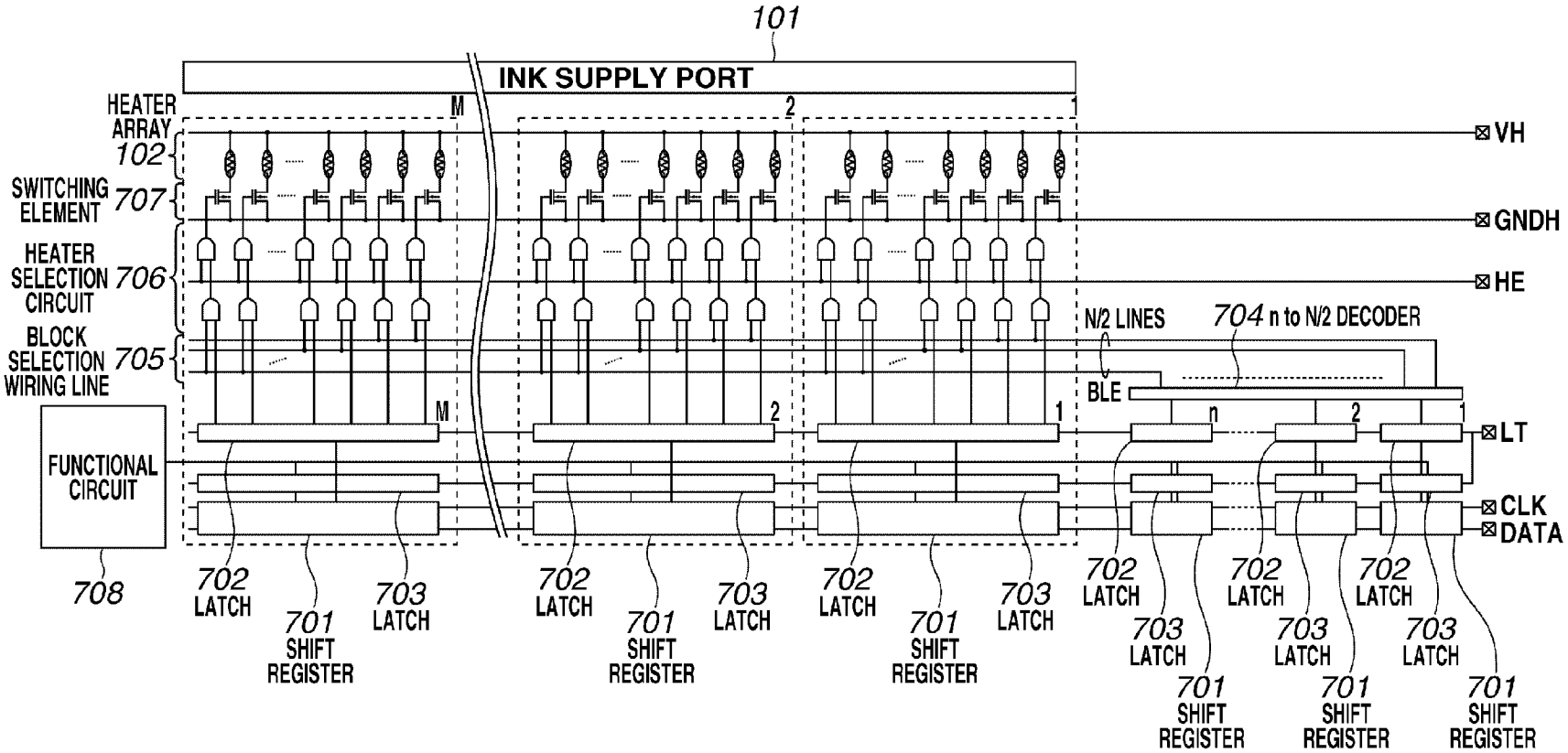
FIG. 7 illustrates a driving circuit of a heater according to a third exemplary embodiment of the present invention.

FIG. 7 illustrates a circuit block equivalent to one row of heater arrays on an element substrate according to a third exemplary embodiment. In the third exemplary embodiment, a functional circuit (setting circuit) 708 is provided on the element substrate. The functional circuit 708 is a current setting circuit (current adjustment circuit) that sets a value of a current to be supplied to heaters. The functional circuit 708 can change the current value by changing a data value to be set.

In the circuit block, data input to a shift register 701 can be output to a heater selection circuit 706 via a latch circuit 702 and to the functional circuit 708 via a latch circuit 703. In order to input data for selecting a heater to be driven and data for setting a value of a current to be supplied to the heater, the shift register 701, a data signal DATA, and a latch signal LT are shared.

Figure 8:
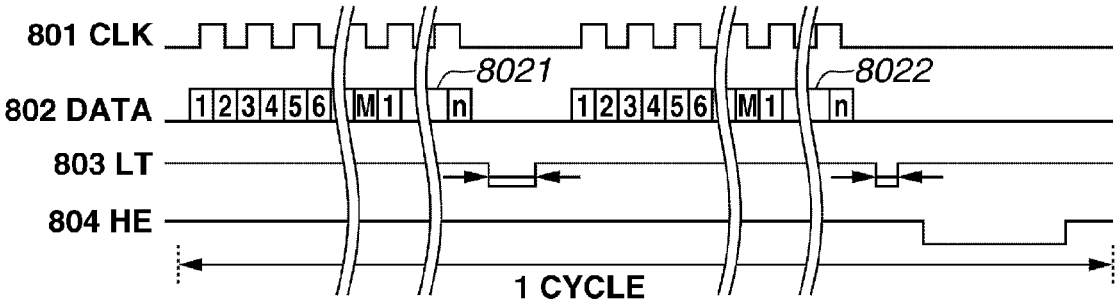
FIG. 8 is a timing chart of signal inputting according to the third exemplary embodiment of the present invention.
Figure 9:
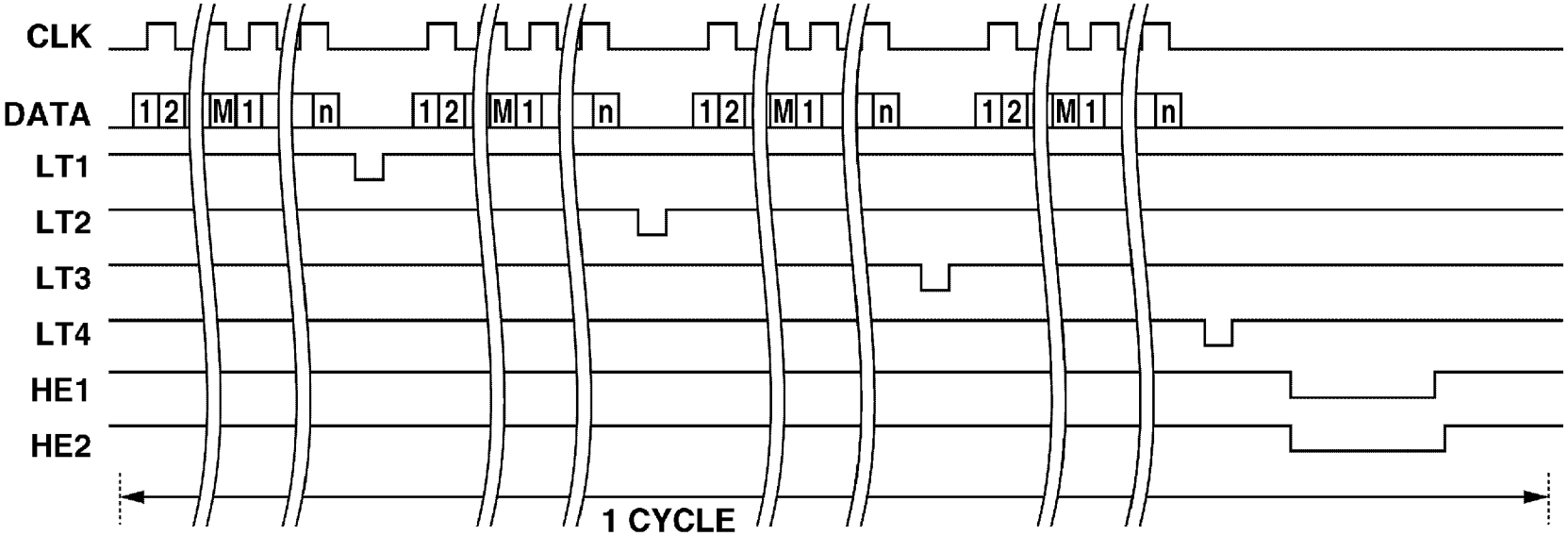
FIG. 9 is a timing chart of signal inputting according to a conventional example.
Figure 10:
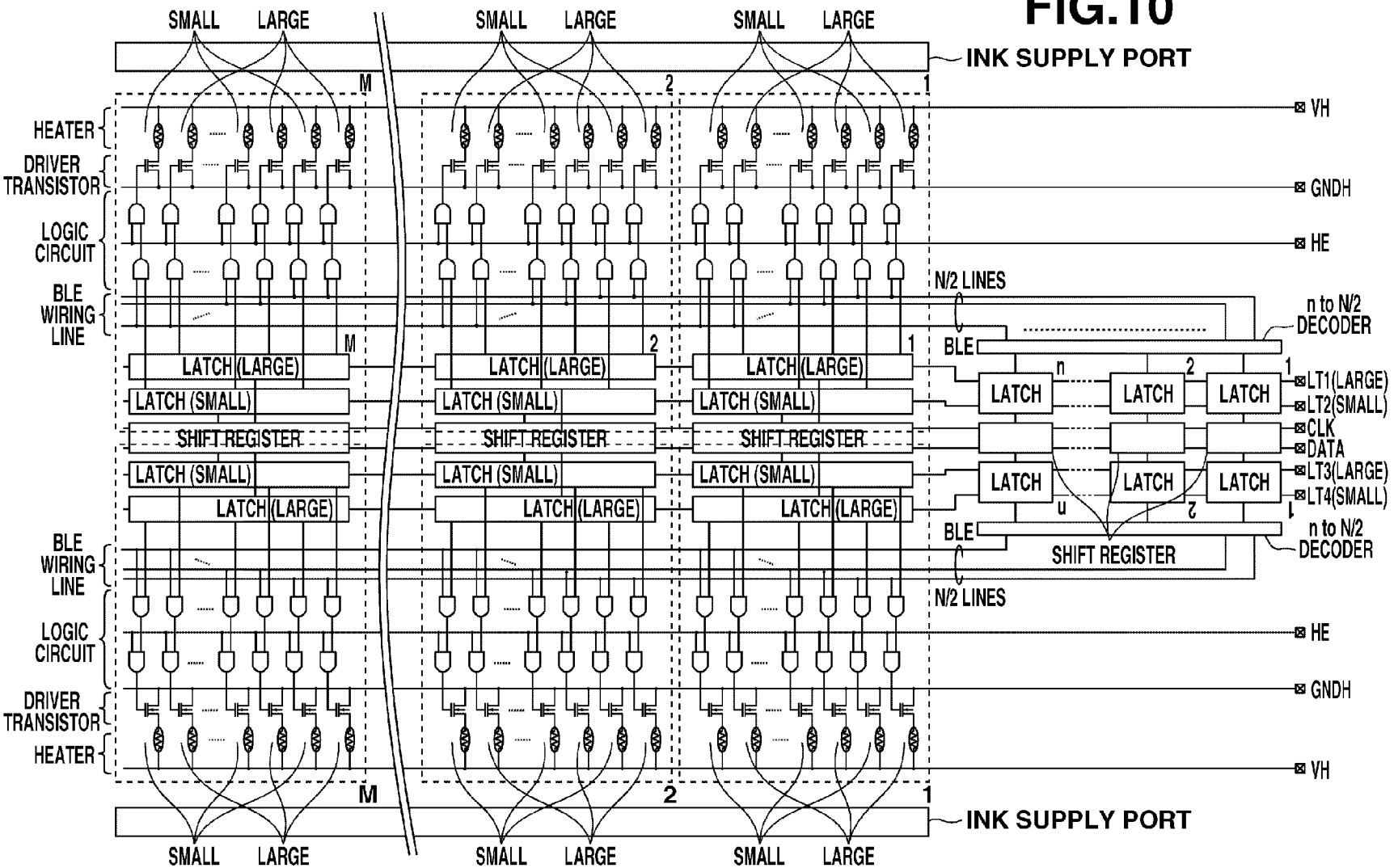
FIG. 10 illustrates a conventional recording element substrate.

FIG. 8 is a timing chart of input signals in one discharge cycle in the third exemplary embodiment. As in the case of the first and second exemplary embodiments, data 8021 and 8022 are input twice in one cycle based on a data signal DATA 802. The data 8021 input first is data input to the functional circuit 708. The data 8022 subsequently input is data output to the heater selection circuit 706.

A second pulse width of a latch signal LT 803 at a low level is shorter than a first pulse width thereof. In other words, a time necessary for the latch circuit 703 for the functional circuit to latch data is longer than that necessary for the latch circuit 702 for the heater selection circuit to latch data.

Appropriate data can be transferred to the functional circuit 708 and the heater selection circuit 706 by varying the pulse width of the latch signal LT 803 and by transferring data corresponding to latching destinations in this manner.

In the third exemplary embodiment, the heater current adjustment circuit has been described as an example of the functional circuit 708. However, the functional circuit is not limited to this function. A pulse width selection circuit may be employed as another example of the functional circuit 708. The pulse width selection circuit has a function for setting a pulse width of a pulse signal to drive a heater. A data signal to set the pulse width is input, and the pulse signal of the pulse width corresponding to a value of the data is applied to the heater. Thus, the pulse width can be changed by changing data to be set. For example, the pulse width selection circuit is configured to change a width of a pre-pulse of a double pulse.

Thus, in a modified example of the third exemplary embodiment, a shift register 701, a data signal DATA, and a latch signal LT are shared in order to input data for selecting a heater to be driven and data for setting a width of a pulse to be applied to the heater.

The following description commonly applies to the first to third exemplary embodiments.

Figure 11:
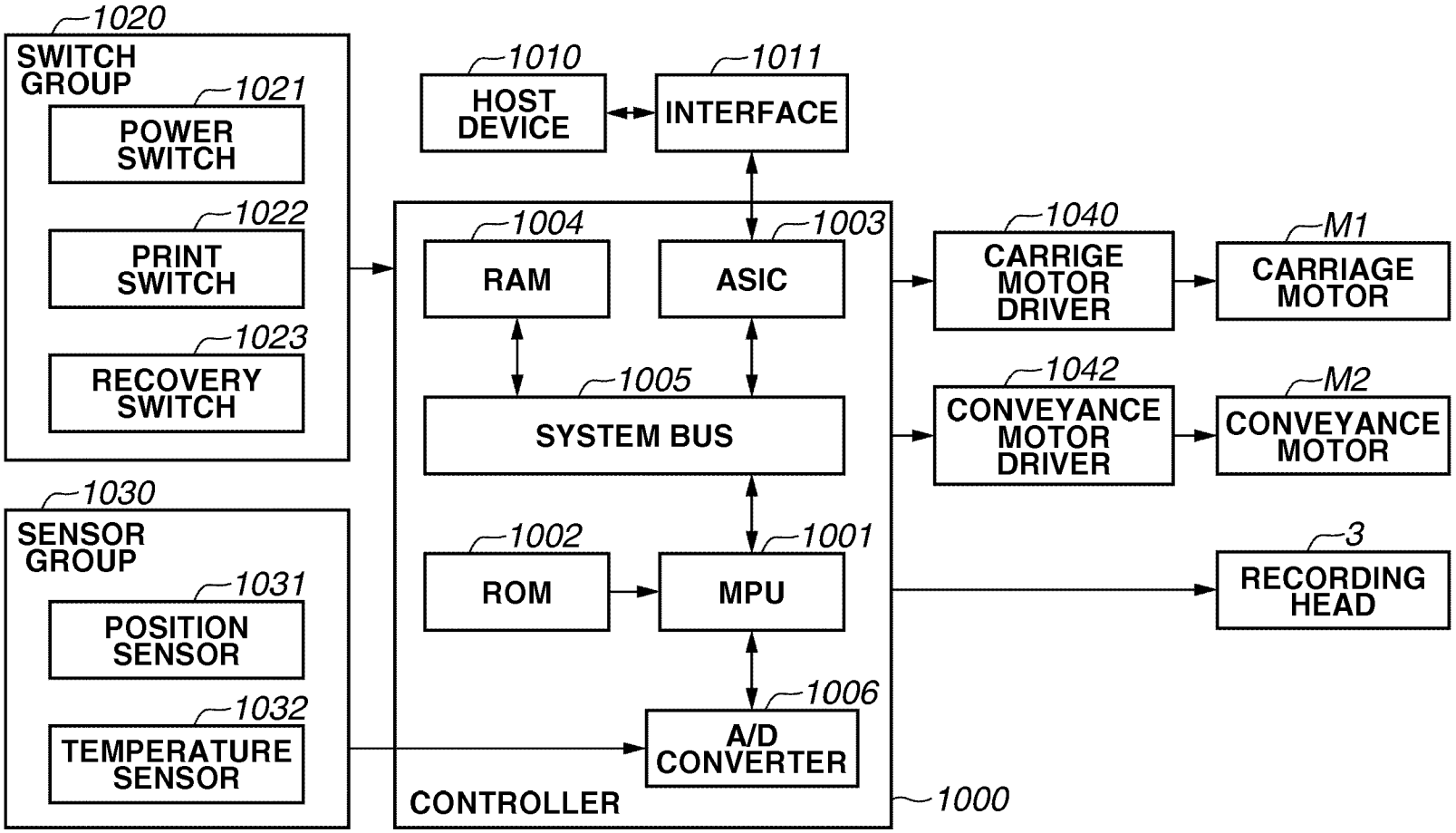
FIG. 11 illustrates a control configuration of a recording apparatus according to an exemplary embodiment of the present invention.

FIG. 11 is a block diagram illustrating a control circuit of an inkjet recording apparatus.

As illustrated in FIG. 11, a controller 1000 includes a micro processing unit (MPU) 1001, a read-only memory (ROM) 1002, an application specific integrated circuit (ASIC) 1003, a random access memory (RAM) 1004, a system bus 1005, and an analog to digital (A/D) converter 1006. The ROM 1002 stores a program, a table, and other fixed data corresponding to a control sequence described below. The ASIC 1003 generates control signals for controlling a carriage motor M1, a conveyance motor M2, and a recording head 3.

The RAM 1004 is used as an image data rasterizing area or a work area for executing a program. The system bus 1005 mutually connects the MPU 1001, the ASIC 1003, and the RAM 1004 to perform data transfer. The A/D converter 1006 receives an analog signal from a sensor group described below to convert the signal into a digital signal, and then supplies the digital signal to the MPU 1001.

A computer 1010 (or a reader for image reading or a digital camera) that serves as a supply source of image data is generically referred to as a host device. Image data, a command, and a status signal are transmitted/received between the host device 1010 and the recording apparatus via an interface (I/F) 1011. The image data is input in, for example, a raster format.

A switch group 1020 includes a power switch 1021, a print switch 1022, and a recovery switch 1023. A sensor group 1030 is for detecting an apparatus state, and includes a position sensor 1031, and a temperature sensor 1032.

A carriage motor driver 1040 is for reciprocate a carriage to scan. A conveyance motor driver 1042 is for driving the conveyance motor M2 to convey a recording medium.

The ASIC 1003 accesses, during recording and scanning by the recording head 3, a storage area of the RAM 1004 to transfer a data signal (DATA) to the recording head 3. The ASIC 1003 generates the latch signal (LT) and the heat enable signal (HE) and transfers the generated signals to the recording head 3.

Figure 12:
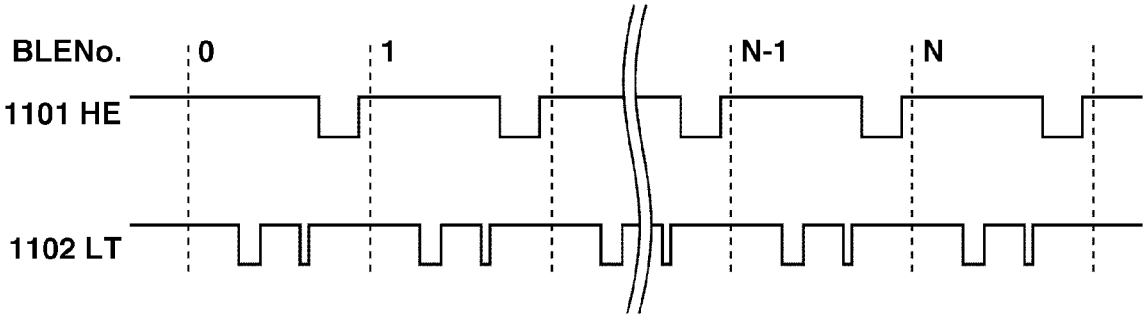
FIG. 12 is a timing chart of a signal transferred from the recording apparatus to a recording head according to the exemplary embodiment of the present invention.

FIG. 12 is a timing chart of a latch signal (LT) 1102 and a heat enable signal (HE) 1101 transferred to the recording head 3 from the controller 1000 provided in the recording apparatus. The latch signal 1102 including two types of pulse widths is input, and the heat enable signal 1101 is input to perform driving by one block. By executing the sequence N times, all of the recording elements to be driven can be sequential driven (time-division driving is performed). The recording head includes the two types of latch circuits, and hence latch signals including two types of pulse widths are transferred.

As described above, when the recording head includes N (plural) types of latch circuits, latch signals including N types of pulse widths are only required to be transferred. In this case, a relationship in pulse width among the latch signals is set such that a first pulse width (time) is the largest, pulse widths are gradually reduced, and an N-th pulse width (time) is the smallest. The pulse width is set corresponding to a time necessary for each latch circuit to latch data.

Figure 13:
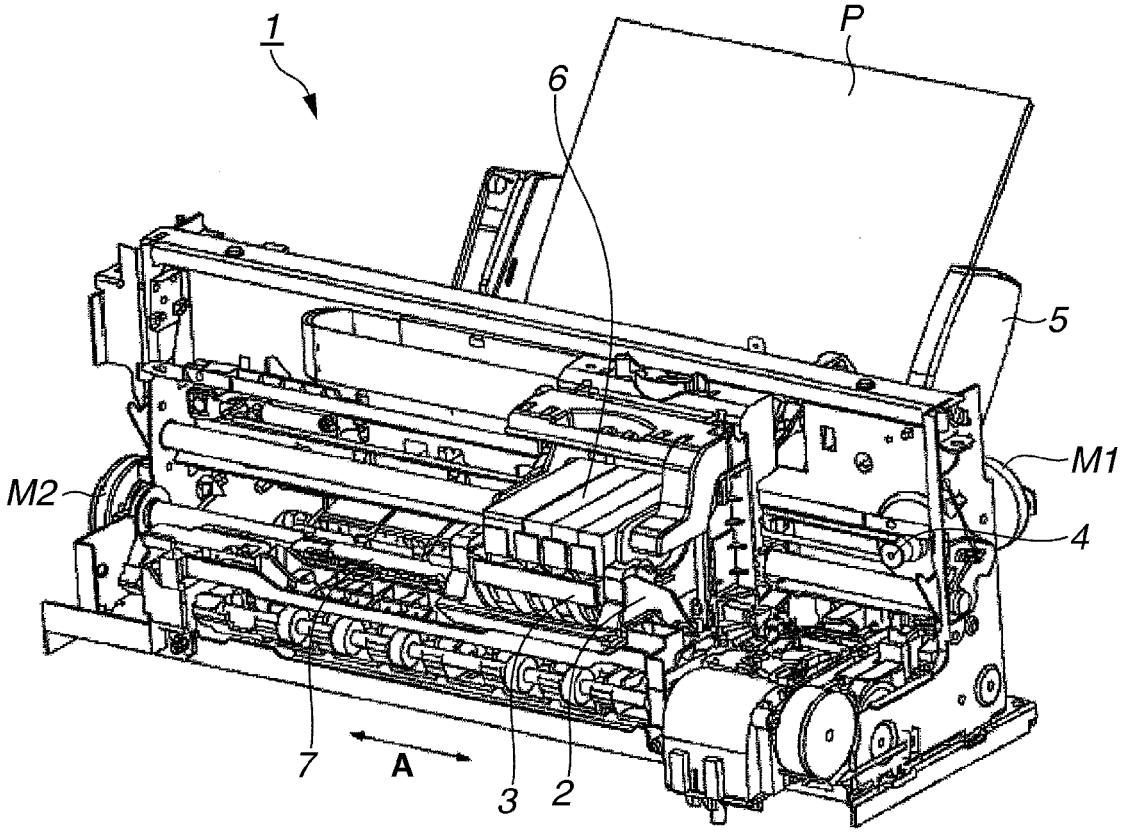
FIG. 13 is a perspective diagram illustrating the recording apparatus of the exemplary embodiment of the present invention.

FIG. 13 is a perspective diagram illustrating an outline of an inkjet recording apparatus 1 which is applied to the above described exemplary embodiment. A transmission mechanism 4 transmits a driving force generated by a carriage motor M1 to a carriage 2 on which the recording head 3 is mounted, so that the carriage 2 is reciprocated in an arrow direction A. The carriage 2 and the recording head 3 have juncture surfaces which are appropriately brought into contact with each other so that a required electrical connection can be achieved and maintained. A sheet feeding mechanism 5 driven by a conveyance motor M2 feeds and conveys a recording medium P to a recording position. Ink is discharged from the recording head 3 to the recording medium P to perform recording at the recording position. A conveyance roller 7 is driven by the conveyance motor M2 to convey the recording medium P.

The carriage 2 of the inkjet recording apparatus 1 is provided with not only the recording head 3 but also an ink cartridge 6 for storing ink to be supplied to the recording head 3. The ink cartridge 6 is detachably mounted to the carriage 2.

The carriage 2 includes four ink cartridges which respectively store inks of magenta (M), cyan (C), yellow (Y), and black (K). These four ink cartridges can be independently detached.

The exemplary embodiments of the present invention have been described. However, the invention is not limited to these exemplary embodiments. For example, allocation of blocks, a number of blocks, and the number of bits of data are not limited to the above described numerical values.

The serial type recording apparatus that performs scanning by the recording head is described above. However, a recording apparatus that includes a recording head corresponding to a width of a recording medium may be employed.

The recording head may be configured to be a recording head cartridge in which an ink tank as a liquid container for performing recording and a recoding element substrate are integrated.

In addition to a general printing apparatus, the present invention can be applied to an industrial recording apparatus combined with an apparatus such as a copying machine, a facsimile or a word processor, and various processing apparatus in a complex manner.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2008-291108 filed Nov. 13, 2008, which is hereby incorporated by reference herein in its entirety.

What is claimed is:

1. A recording element substrate which is provided with a first recording element group and a second recording element group, each group including a plurality of recording elements, the recording element substrate comprising:

a first terminal configured to input a data signal;

a second terminal configured to input a latch signal;

a shift register configured to receive the data signal input from the first terminal;

a first latch circuit configured to latch data stored in the shift register based on the latch signal of a first pulse width input from the second terminal;

a second latch circuit configured to latch the data stored in the shift register based on the latch signal of a second pulse width which is shorter than the first pulse width of the latch signal input from the second terminal;

a first driving circuit configured to control driving of the recording elements included in the first recording element group based on a signal output from the first latch circuit; and a second driving circuit configured to control driving of the recording elements included in the second recording element group based on a signal output from the second latch circuit.

2. The recording element substrate according to claim 1, further comprising an input unit configured to input a latch signal of a pulse of the first pulse width subsequently to a data signal for driving the recording elements of the first recording element group, and input a latch signal of a pulse of the second pulse width subsequently to a data signal for driving the recording elements of the second recoding element group.

3. The recording element substrate according to claim 2, wherein the input unit further inputs a permission signal for permitting driving of the recording elements, subsequently to the pulse of the first pulse width and the pulse of the second pulse width.

4. The recording element substrate according to claim 1, wherein the first and second driving circuits drive the recording elements based on the permission signal.

5. The recording element substrate according to claim 1, wherein the first recording element group is a first recording element array and the second recording element group is a second recording element array, and the first latch circuit and the second latch circuit are arranged to sandwich the shift register between the first recording element array and the second recording element array.

6. A recording head comprising the recording element substrate according to claim 1.

7. A recording apparatus comprising a generation circuit configured to generate a latch signal, a data signal, and a permission signal for the recording head according to claim 6.

8. A recording element substrate which is provided with a recording element group including a plurality of recording elements, the recording element substrate comprising:

an input unit configured to input a latch signal and a data signal;

a shift register configured to receive the data signal;

a first latch circuit configured to latch data stored in the shift register based on a latch signal of a first pulse width;

a second latch circuit configured to latch the data stored in the shift register based on a latch signal of a second pulse width which is shorter than the first pulse width;

a driving circuit configured to drive the recording elements included in the recording element group based on a signal output from the first latch circuit; and a setting circuit configured to set a driving condition of the recording elements included in the recording element group based on a signal output from the second latch circuit.

9. The recording element substrate according to claim 8, wherein the driving condition includes at least one of a current value for driving the recording elements and a time for drive of the recording elements to perform one ink discharging operation.

* * * * *